US005916035A

United States Patent [19]

Caiozzo

[11] Patent Number: 5,916,035

[45] Date of Patent: Jun. 29, 1999

[54] GOLF PUTTER HEAD

[75] Inventor: Joseph Caiozzo, Glen Head, N.Y.

[73] Assignee: J. P. Caswell Golf Co. Inc., Glen Head, N.Y.

[21] Appl. No.: 09/036,381

[22] Filed: Mar. 6, 1998

Related U.S. Application Data

[60] Provisional application No. 60/056,695, Aug. 28, 1997.

[51] Int. Cl.[6] ..... A63B 53/04

[52] U.S. Cl. ..... 473/252; 473/313; 473/341

[58] Field of Search ..... 473/251, 252, 473/253, 254, 255, 256, 313, 314, 324, 340, 341, 349, 350; D21/736, 737, 738, 739, 740, 741, 742, 743, 744, 745, 746

[56] References Cited

U.S. PATENT DOCUMENTS

D. 291,908 9/1987 Glennon .
D. 324,556 3/1992 Guerin .
D. 350,177 8/1994 Ramirez .
D. 356,613 3/1995 Adams .
D. 359,330 6/1995 Channel .
D. 366,081 1/1996 Patten .
4,762,324 8/1988 Anderson .
5,464,218 11/1995 Schmidt et al. .

*Primary Examiner*—Sebastiano Passaniti
*Attorney, Agent, or Firm*—Collard & Roe, P.C.

[57] ABSTRACT

A golf putter head comprising an elongated front section having a flat front hitting surface, an arcuate cavity extending from the back surface toward the hitting surface, and a substantially semicircular rear section attached to and extending back from the front section. The rear section has a semicircular lip arranged around the edge, and a keyhole-shaped cutout extending from a rearmost point of the rear section toward a center point of the front section. The putter head has a beveled bottom surface encompassing the front and rear sections. A plurality of parallel grooves are arranged on the top surface of the front section. The grooves run in a direction perpendicular to the plane of the hitting surface and are arranged above the arcuate cavity. The grooves define an optimum area for hitting a golf ball. A shaft may be mounted on the top surface of the front section to form a complete golf putter.

8 Claims, 3 Drawing Sheets

GOLF PUTTER HEAD

This is a non-provisional application based upon provisional application Ser. No. 60/056,695 filed on Aug. 28, 1997.

BACKGROUND OF THE INVENTION

1. Field of the Invention

This invention relates to a golf putter. In particular, the invention relates to an improved golf putter head that achieves optimum weight distribution and balance, as well as guides the golfer toward a straight putt.

2. The Prior Art

There are many type of golf putters available today, ranging from the traditional bar-shaped straight putter to a semicircular type, and many other designs. The shape and weight distribution of the putter can have a significant effect on the accuracy of a golfer's putt. Since the putt is the weakest part of many golfers' games, numerous attempts have been made to improve upon the standard golf putter in the hopes of improving the golfers' scores.

In addition to altering the shape and weight distribution of the putter head, which determines the linear accuracy of the putt, there have been many attempts to devise a way to prevent angular errors in the putts. This is done primarily with visual aids such as lines, dots and cut-outs in the putter, which serve to direct the golfer's eyes and therefore body in the desired direction.

Several examples of putters are shown in U.S. Design Pat. Nos. 291,908 to Glennon et al., 324,556 to Guerin, Sr., 351,177 to Ramirez et al., 359,330 to Channell, 366,081 to Patten, and 356,613 to Adams et al. These patents all show golf putters having a portion of the trailing side of the putter head cut away. This cut-out eliminates excess weight in the putter head, and serves to push the majority of the weight of the putter head to the sides. This configuration increases the balance and accuracy of a putt. However, all of these putters suffer from several drawbacks, including insufficient visual guiding and a less than optimum weight distribution of the putter head.

SUMMARY OF THE INVENTION

It is an object of the present invention to provide an improved golf putter head that achieves optimum weight distribution for improved accuracy in putting, and provides the golfer with mor consistency in distance when striking the face of the putter off of the center or "sweet spot".

It is another object of the present invention to provide a golf putter head that visually guides the golfer to hit a straight putt by squaring the putter to the intended line or path of the putt.

It is yet another object of the present invention to provide a golf putter head that is aesthetically pleasing and comfortable to use.

These and other objects of the invention are achieved by a golf putter head comprising an elongated front section having a flat front hitting surface, an arcuate cavity extending from the back surface toward the hitting surface, and a substantially semicircular rear section attached to and extending back from the front section. The rear section has an upwardly—extending semicircular lip arranged around the edge, and a keyhole-shaped cutout extending from a rearmost point of the rear section toward a center point of the front section.

The putter head has a beveled bottom surface encompassing the front and rear sections. A plurality of parallel grooves are arranged on the top surface of the front section above the cavity. The grooves run in a direction perpendicular to the plane of the hitting surface and are arranged above the arcuate cavity. The grooves define an optimum area for hitting a golf ball, i.e., the "sweet spot". A shaft may be mounted on the top surface of the front section to form a complete golf putter.

The keyhole shaped cutout and the cavity in the front portion create an optimum weight distribution of the putter head. This particular configuration keeps most of the weight of the putter head out to the sides, and provides a large "sweet spot" for hitting the golf ball. The precise configuration of the putter head provides enough weight to ensure a comfortable swing and pendulum-like momentum, while providing sufficient control and accuracy by the unique visual aids on the putter head and by removing a portion of the weight from the center of the putter head.

In the putter head according to the invention, the weight distribution runs away from the center sight line out to the sides and toward the back. This ensures the center line and sweet spot are one and the same. This feature is not always true with other putters, as the sweet spot may be closer to the shaft and not on the center sight line. This inconsistency creates problems for golfers who attempt to line up their putts on the center line, prompting twisting and inconsistency when striking the ball.

The weight distribution of this invention combines several factors, all of which are designed to afford the golfer improved consistency when putting, even if the center line or sweet spot is not struck when stroking the putt. The weight distribution of the present invention is achieved by removing material from the back of the face to a predetermined thickness, forming the cavity, and then gradually increasing the weight toward the outside. The "wings" of the sides of the putter head and the keyhole shape are weighted and shaped to create an area or zone directly behind the center sight line. This weight distribution will deliver a solid feel to the golfer if the putt is struck on the center sight line, and a similar result even if not struck precisely in the center but within the slotted area. This is accomplished because the weight removal behind the putting face affects the mishit both laterally along the face and also vertically, from top to bottom.

The lip preferably decreases in height from the front section toward a rearmost portion of the putter head until it reaches the keyhole-shaped cutout. The keyhole-shaped cutout has a circular front portion that has a diameter larger than the spacing between the outermost grooves on the top surface of the front section. The point at which the circular portion meets the lower widened portion has a width equal to the spacing between the grooves on the front section. This provides an optimum visual guide for the golfer, because it directs the golfers eyes in a straight path from the keyhole-shaped cutout, through the grooves and toward the hole in the green. The distance between the frontmost point of the circular portion and the point at which it meets the widened rear portion of the keyhole is approximately equal to the thickness of the front portion. These dimensions of the keyhole have shown to increase the size of the sweet spot and provide for more accurate putts when the ball is struck off-center. In addition, the cutout and grooves are large enough to occupy the golfer's visual field and define a path, rather than a thin line for the golf ball to travel. This wider path ensures greater accuracy in putting.

There are preferably three grooves on the top surface of the front portion.

In a preferred embodiment, the cavity spans approximately two-thirds the length of the front section, and has a height that decreases from the rear of the front section toward the front of the front section. This serves to further increase the accuracy of the putt by making the "sweet spot" as large as possible, without sacrificing stability. If the putter is too light, the golfer will not be comfortable and will not have control over the putter, especially with longer putts. Consistency is also sacrificed when there is insufficient weight to create a pendulum-like swing. However, if the putter is too heavy, accuracy is sacrificed, especially with short putts. While the overall weight of the putting head is a subjective preference of the individual golfer, the weight distribution of the putting head of the present invention creates greater consistency on off-center hits, which improves a golfer's overall performance on the putting green.

BRIEF DESCRIPTION OF THE DRAWINGS

Other objects and features of the present invention will become apparent from the following detailed description considered in connection with the accompanying drawings which disclose one embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENT

Figure 1:
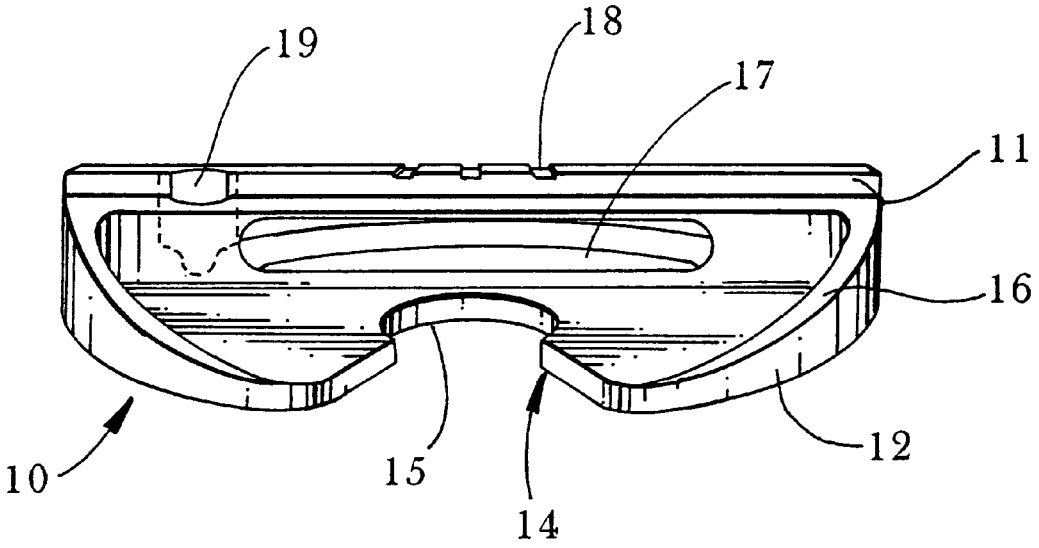
FIG. 1 shows a perspective view of the golf putter head according to the invention.
Figure 2:
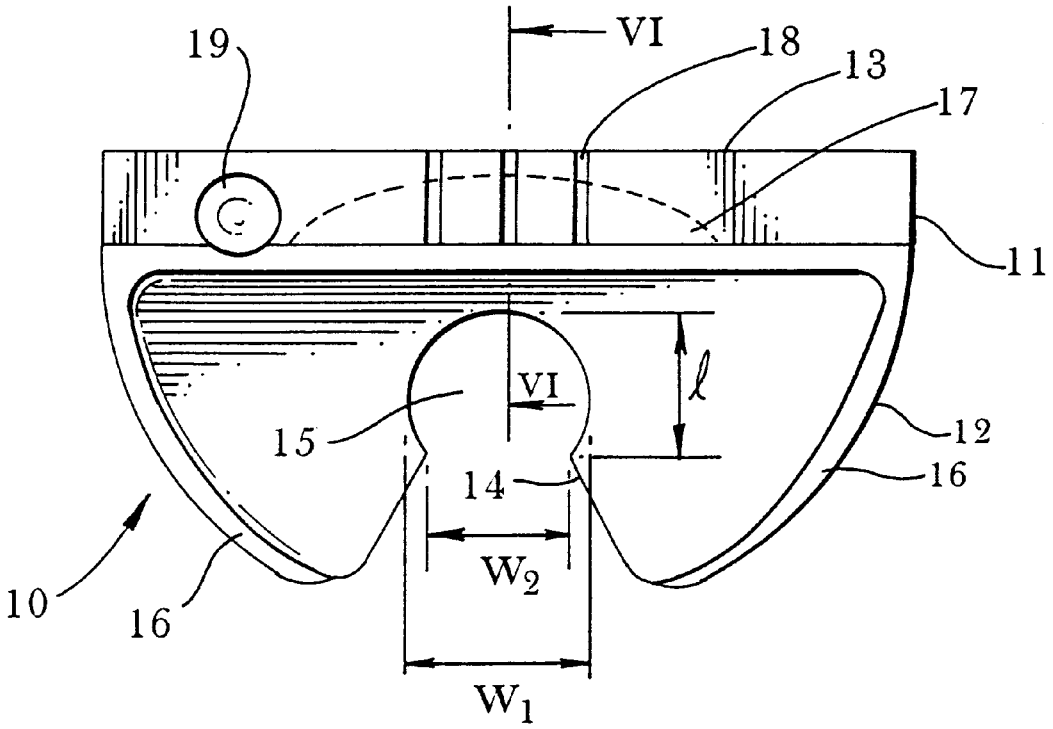
FIG. 2 shows a top view of the golf putter head according to the invention.

Turning now in detail to the drawings, FIGS. 1 and 2 show top views of the golf putter head 10 according to the invention. Putter head 10 comprises a flat front section 11 and a semicircular rear section 12 integrally formed therewith.

Rear section 12 has a keyhole-shaped cutout 14 that extends from its rearmost edge toward front section 11. Cutout 14 has a circular front portion 15. Rear section 12 also has an upwardly-extending lip 16 surrounding the edges of rear section 12. The height of lip 16 decreases from the front of putter head 10 toward the rear, and ends at cutout 14.

Figure 4:
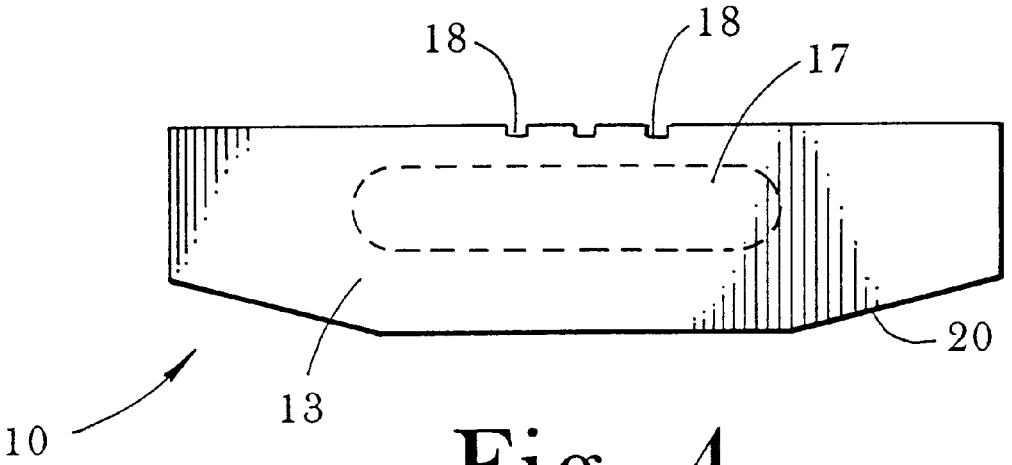
FIG. 4 shows a front view of the golf putter head according to the invention.
Figure 5:
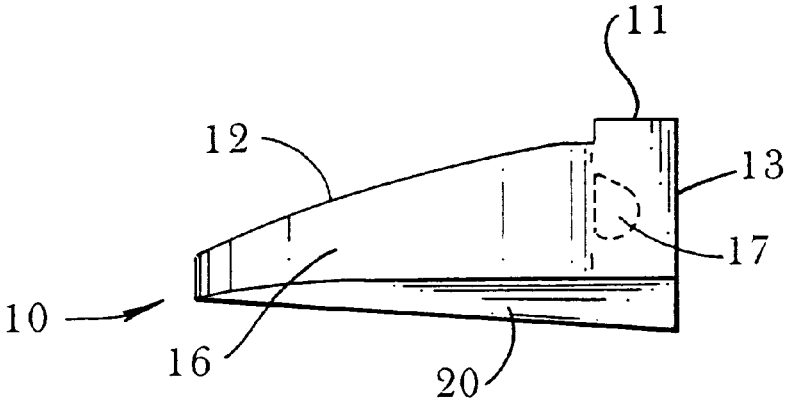
FIG. 5 shows a side view of the golf putter head according to the invention.

Front section 11 has a substantially flat hitting face 13, which is shown in FIGS. 4 and 5. There are a plurality of grooves 18 arranged on the top of front section 11. Grooves 18 are arranged perpendicular to hitting face 13. Grooves 18 are arranged to define a "sweet spot" in which the best and most accurate putts are hit. The width $w_1$ of circular portion 15 at its widest point is larger than the distance between the outermost grooves 18. The width $w_2$ of circular portion 15 at its rearmost point, i.e, where it meets the rear triangular part of keyhole-shaped cutout 14 is equal to the distance between the outermost grooves 18. The length l of the circular portion 15, i.e, the distance between the frontmost point of circular portion 15 and the point at which the keyhole-shaped cutout 14 widens toward the rear is equal to the thickness of front portion 11. These dimensions help to create a visual pathway to guide the golfer toward the pin and also to improve the weight distribution of the putter. The combination of keyhole-shaped cutout 14 with its circular portion 15, along with grooves 18 provides a unique visual guide for the golfer, and defines a precise hitting pathway for the putt.

Figure 3:
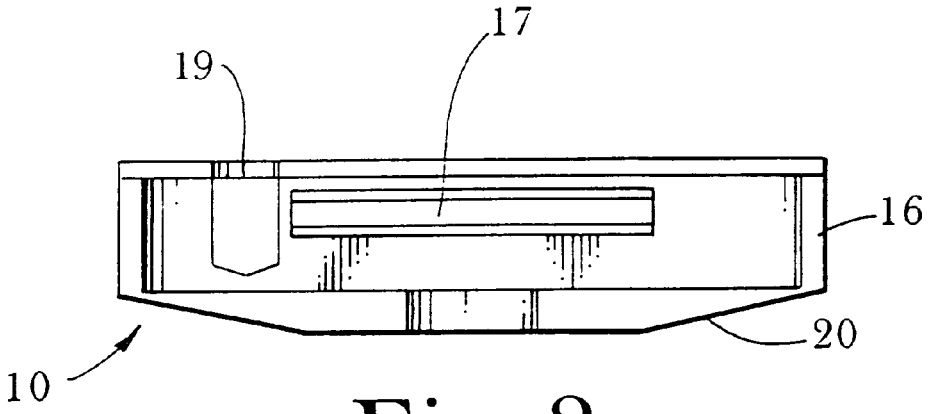
FIG. 3 shows a rear view of the golf putter head according to the invention.
Figure 6:
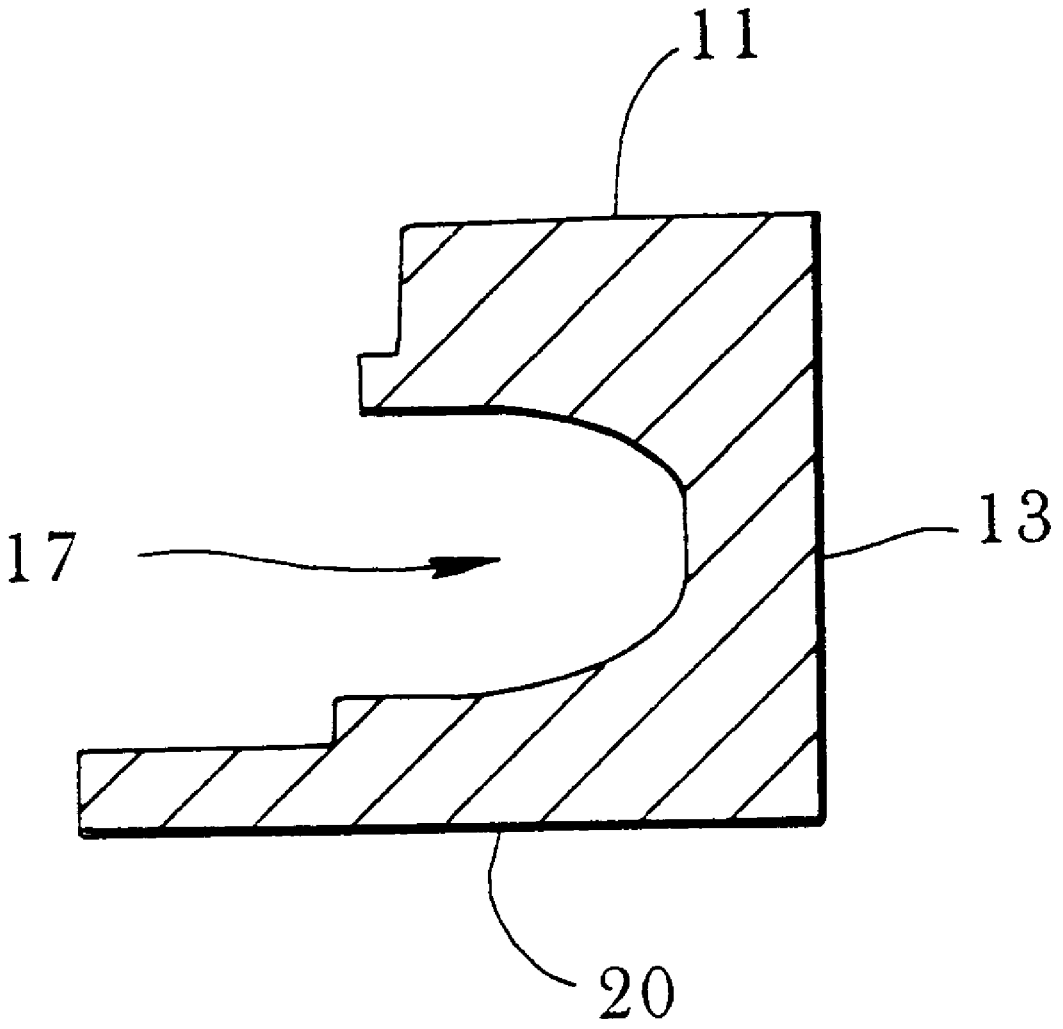
FIG. 6 shows a side cross-sectional view along lines VI—VI of FIG. 2.

The "sweet spot" of putting head 10 is created by a semicircular cavity 17 cut into front section 11, as shown in FIGS. 1–3. Cavity 17 eliminates some of the weight in the center of putter head 10 and provides an area on hitting face 13 in which putts are more accurate. Circular portion 15 is cut to mirror the shape of cavity 17 as much as possible to further eliminate the weight at the center of the putter head and improve the accuracy in putting. As shown in FIG. 6, cavity 17 decreases in height toward hitting face 13. This particular shape provides for the largest possible sweet spot without sacrificing consistency in the putting. Consistency is reduced when too much weight is removed from the putting head. Increasing the size of the sweet spot is important because it improves the accuracy of putts in which the ball strikes the putting head off-center. If the sweet spot is large enough, an accurate putt will still be achieved. Cavity 17 also provides for a soft feel to the putter when striking the ball. In addition, cavity 17 is shaped so that putts that are off center both vertically and horizontally are hit with greater accuracy.

To provide increased comfort and versatility for the golfer, putting head 10 has a beveled bottom edge 20, shown in FIGS. 3 and 4. Beveled bottom edge 20 also reduces the possibility of striking the ground while putting. Beveling the bottom edge 20 also improves the balance and weight distribution of putting head 20, and helps to provide a soft feel when striking the ball.

Putting head 10 is also equipped with a hole for mounting a shaft thereto. Putting head 10 is preferably made of steel, but other materials could also be used.

While only one embodiment of the present invention has been shown and described, it is to be understood that many changes and modifications may be made thereunto without departing from the spirit and scope of the invention as defined in the appended claims.

What is claimed is:

1. A golf putter head, comprising:

an elongated front section having a flat hitting surface, a top surface, a back surface, a width and an arcuate cavity extending from the back surface toward the hitting surface;

a substantially semicircular rear section attached to and extending back from said front section, said rear section having an edge and an upwardly-extending semicircular lip arranged around said edge, and a keyhole-shaped cutout extending from a rearmost point of the rear section toward a center point of the front section;

a beveled bottom surface encompassing the front and rear sections;

a plurality of parallel grooves arranged on the top surface of the front section, said grooves running in a direction perpendicular to the plane of the hitting surface and arranged above the arcuate cavity, said grooves including outermost grooves that define an optimum area for hitting a golf ball; and means on the top surface of the front section for mounting a shaft.

2. The golf putter head according to claim 1, wherein the lip decreases in height from the front section toward a rearmost portion of the putter head.

3. The golf putter head according to claim 1, wherein the cavity spans approximately two-thirds the length of the front section.

4. The golf putter head according to claim 1, wherein the keyhole shaped cutout has a circular front portion having a frontmost point, a rearmost point and wherein said circular front portion has a diameter greater than the spacing between the outermost grooves on the top surface of the front section.

5. The golf putter head according to claim 1, wherein there are three grooves.

6. The golf putter head according to claim 1, wherein the arcuate cavity has a height that decreases from a rear of the front section toward a front of the front section.

7. The golf putter head according to claim 4, wherein the rearmost point of the circular front portion has a width equal to the distance between the outermost grooves.

8. The golf putter head according to claim 7, wherein the distance between the rearmost point of the circular front portion and the frontmost point of the circular front portion is equal to the width of the front section.

* * * * *